US007093918B2

(12) United States Patent
Askeland et al.

(10) Patent No.: US 7,093,918 B2
(45) Date of Patent: Aug. 22, 2006

(54) DOUBLE DOTTING FOR GRAIN EQUALIZATION

(75) Inventors: Ronald A. Askeland, San Diego, CA (US); Wayne M. Richard, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 288 days.

(21) Appl. No.: 10/826,049

(22) Filed: Apr. 16, 2004

(65) Prior Publication Data

US 2005/0231549 A1 Oct. 20, 2005

(51) Int. Cl.

| | |
|---|---|
| ***B41J 29/393*** | (2006.01) |
| ***B41J 2/205*** | (2006.01) |
| ***B41J 2/145*** | (2006.01) |
| ***B41J 2/15*** | (2006.01) |
| ***B41J 2/14*** | (2006.01) |
| ***B41J 2/16*** | (2006.01) |

(52) U.S. Cl. ..... 347/19; 347/15; 347/40; 347/49

(58) Field of Classification Search ..... None
See application file for complete search history.

(56) References Cited

U.S. PATENT DOCUMENTS

| | | | | |
|---|---|---|---|---|
| 4,672,432 | A | | 6/1987 | Sakurada et al. |
| 4,746,935 | A | | 5/1988 | Allen |
| 4,748,453 | A | | 5/1988 | Lin et al. |
| 4,963,882 | A | | 10/1990 | Hickman |
| 5,574,832 | A | | 11/1996 | Towery et al. |
| 5,583,550 | A | | 12/1996 | Hickman et al. |
| 6,042,211 | A | | 3/2000 | Hudson et al. |
| 6,062,674 | A | * | 5/2000 | Inui et al. ..... 347/43 |
| 6,155,670 | A | | 12/2000 | Weber et al. |
| 6,259,463 | B1 | | 7/2001 | Askeland et al. |
| 6,575,545 | B1 | | 6/2003 | Bruch et al. |
| 6,585,340 | B1 | | 7/2003 | Borrell |
| 2003/0048316 | A1 | | 3/2003 | Bruch et al. |

* cited by examiner

*Primary Examiner*—Thinh Nguyen
(74) *Attorney, Agent, or Firm*—James R. McDaniel

(57) ABSTRACT

This invention relates to a method for grain equalization utilizing double dotting, comprising the steps of: determining a drop weight of each die in a multi-die printhead to print a given ink; determining the highest drop weight amongst all the dies; and determining a percentage of double dotting that is needed to substantially match a grain of the highest drop weight die.

32 Claims, 5 Drawing Sheets

DOUBLE DOTTING FOR GRAIN EQUALIZATION

BACKGROUND OF THE INVENTION

1. Field of the Invention

This invention relates to a method for grain equalization utilizing double dotting, comprising the steps of: determining a drop weight of each die in a multi-die printhead to print a given ink; determining the highest drop weight amongst all of the dies; and determining a percentage of double dotting that is needed to substantially match a grain of the highest drop weight die.

2. Description of the Related Art

Compared to thermal ink jet printing systems that employ only a single die for each primary color, multi-die architectures present unique challenges in the area of color consistency. For printers using a single die for a given ink, die-to-die drop weight differences can cause color shifts between print jobs, but the color remains consistent within each print, as shown in FIG. 1*a*. As can be seen in FIG. 1*a*, there is a color shift between print A and print B even though both prints were printed by the same type of print head but of different drop weights for the same ink color. In contrast, for multi-die systems, uncompensated die-to-die drop weight differences can cause bands of visible color differences within any given print job, as shown in FIG. 1*b*. Even small differences in drop weight between dies can become visible and reduce customer satisfaction.

It is known in the color compensation art to employ a color compensation algorithm. Using the color compensation algorithm, the relative printed dot densities, or numbers of dots per unit area, can effectively be adjusted at the individual die level. This compensates for natural drop weight variations caused by the manufacturing process, as well as colorant concentration differences and establishes better color consistency between prints generated from different dies of the same color.

For multiple die per color printing systems, while the color compensation algorithm can match colors between dies with different drop weights, grain differences can be observed between printed die regions when drop weight variation exceeds a threshold (approximately 15%). FIG. 2*a* illustrates printing an area fill with a high drop weight. FIG. 2*b* illustrates what happens with a low drop weight die when the color compensation algorithm is used for color matching. Even though the color between the high drop weight area fill and the low drop weight area fill may be similar, FIG. 2*a* has significantly higher grain in FIG. 2*b*.

It is also known that trickle warming can be used to raise the temperature of low drop weight dies. Dies operated at a higher temperature have a higher drop weight. By setting the trickle warming temperatures of individual dies appropriately, equal drop weights can be established between them. However, the drop volume range in which trickle warming can be used is limited. Independent of drop weight, trickle warming is used to improve drop ink ejection performance and reliability by warming a die to a minimum temperature (i.e. 45° C. trickle warming set point). A high drop weight die cannot use a trickle warming temperature that is lower than a minimum trickle warming set point selected for drop ejection performance and reliability. Higher trickle warming temperatures can cause problems with material's reliability, ink out-gassing, and puddling. Conversely, a low drop weight die cannot use a trickle warming temperature that is higher than the maximum trickle warming set point. In short, the trickle warming approach can only be used over an allowed temperature range that limits the ability to adjust for larger drop volume variations between dies.

It is apparent from the above that there exists a need in the art for a color compensation method and apparatus that reduces graininess in multi-die inkjet printing systems through the use of double dotting and does not rely heavily upon the utilization of the trickle warming approach It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a method for grain equalization utilizing double dotting, comprising the steps of: determining a drop weight of each die in a multi-die printhead to print a given ink; determining the highest drop amongst all of the dies; and determining a percentage of double dotting that is needed to substantially match a grain of the highest drop weight die.

In certain preferred embodiments, the graininess in a print job can be equalized through the use of double dotting. A color compensation algorithm can be used in conjunctions with double dotting to equalize the color from each die.

The preferred print job grain equalization method, according to various embodiments of the present invention, offers the following advantages: ease-of-use; excellent grain equalization characteristics; excellent color density characteristics; excellent color compensation algorithm characteristics; and increased customer satisfaction. In fact, in many of the preferred embodiments, the combination of grain equalization, color density, and the color compensation algorithm are optimized to an extent that is considerably higher than heretofore achieved in prior, known print job grain equalization methods.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1A:
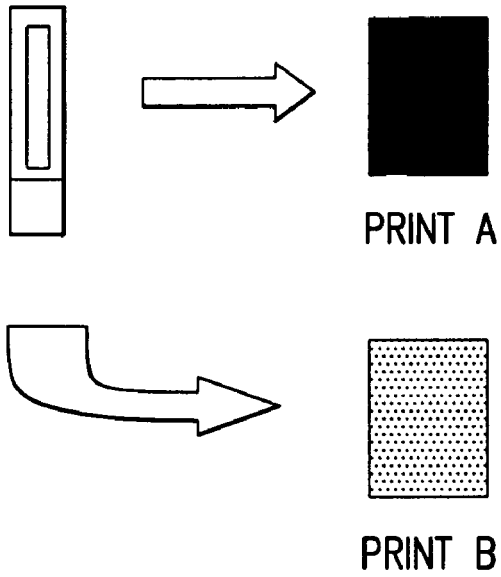
FIG. 1a PRIOR ART
FIGS. 1*a* and 1*b* are schematic illustrations that illustrate single die color consistency and multi-die color consistency, respectively, according to prior art.
Figure 1B:
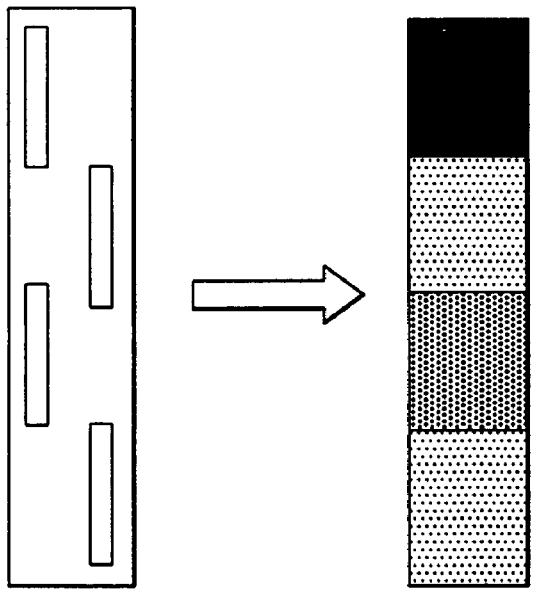
FIG. 1b PRIOR ART
Figure 2A:
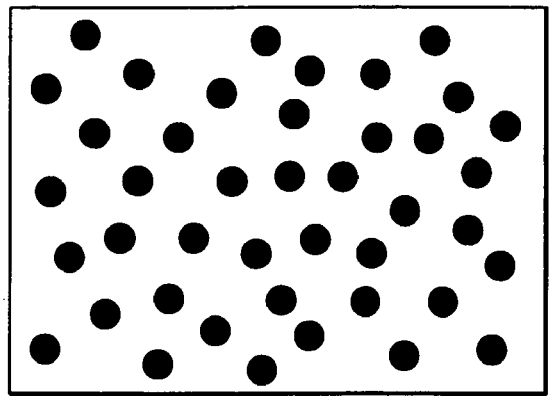
FIGS. 2*a*–2*c* illustrate various area fills for a high drop weight die, according to the prior art (FIG. 2*a*), a low drop weight die, according to the prior art (FIG. 2*b*), and a low drop weight die printed with a mixture of single and double dotting (FIG. 2*c*), according to one embodiment of the present invention.
Figure 2B:
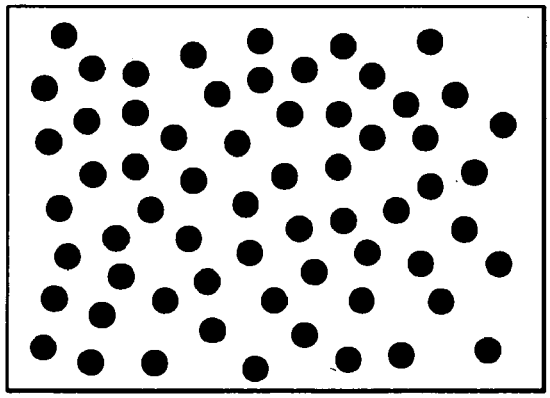
Figure 2C:
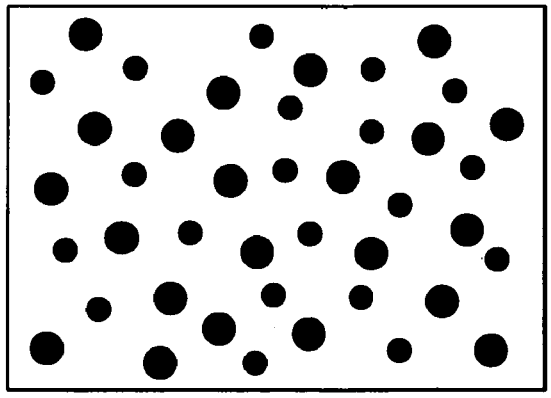

With reference first to FIG. 2*c*, there is illustrated one preferred embodiment for use of the concepts of this invention. The term "double dotting" is used to describe ejecting two droplets from the same inkjet nozzle with a short time delay so that the droplets merge on the media to form a single dot. See, for example, commonly assigned, U.S. Pat. No. 6,259,463 ('463) to R. A. Askeland et al., entitled "Multi-drop Merge on Media Printing System", which is hereby incorporated in its entirety by reference. With respect to the present invention, the grain of a small drop weight die can be increased to equal that of a large drop weight die by printing a fraction of the small drop weight dots as double dots, as shown in FIG. 2*c*.

Figure 3:
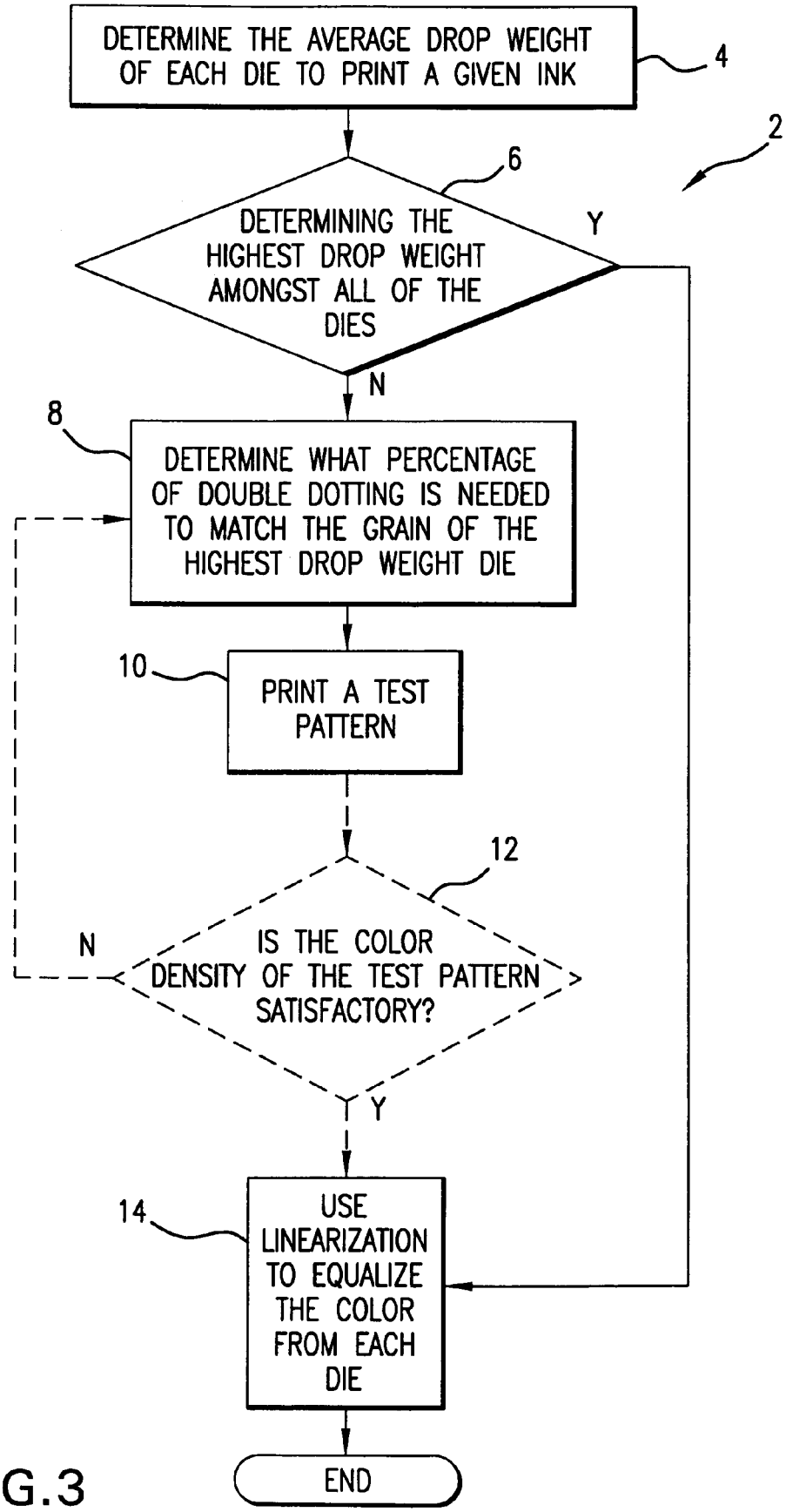
FIG. 3 is a flowchart of a method for grain equalization in a print job, according to one embodiment of the present invention.

FIG. 3 is flowchart of the method 2 for grain equalization in a print job. As shown in FIG. 3, method 2 includes, in part, the steps of: determining the average drop weight of each die to print a given ink (step 4); determining the highest drop weight that is being used amongst all of the dies (step 6); determining what percentage of double dotting is needed to match the grain of the highest drop weight die (step 8); printing a test pattern (step 10) for evaluating density differences; determining if the color densities of the test pattern are satisfactory (step 12); and using a color compensation algorithm to equal color from each die (step 14).

With respect to step 4, the average drop weight of each die to print a given ink in a multi-die printing system is determined according to well-known, conventional techniques. As discussed previously, for multiple die per color printing systems, uncompensated die-to-die drop weight differences can cause bands of visible color differences within any given print.

Figure 5:
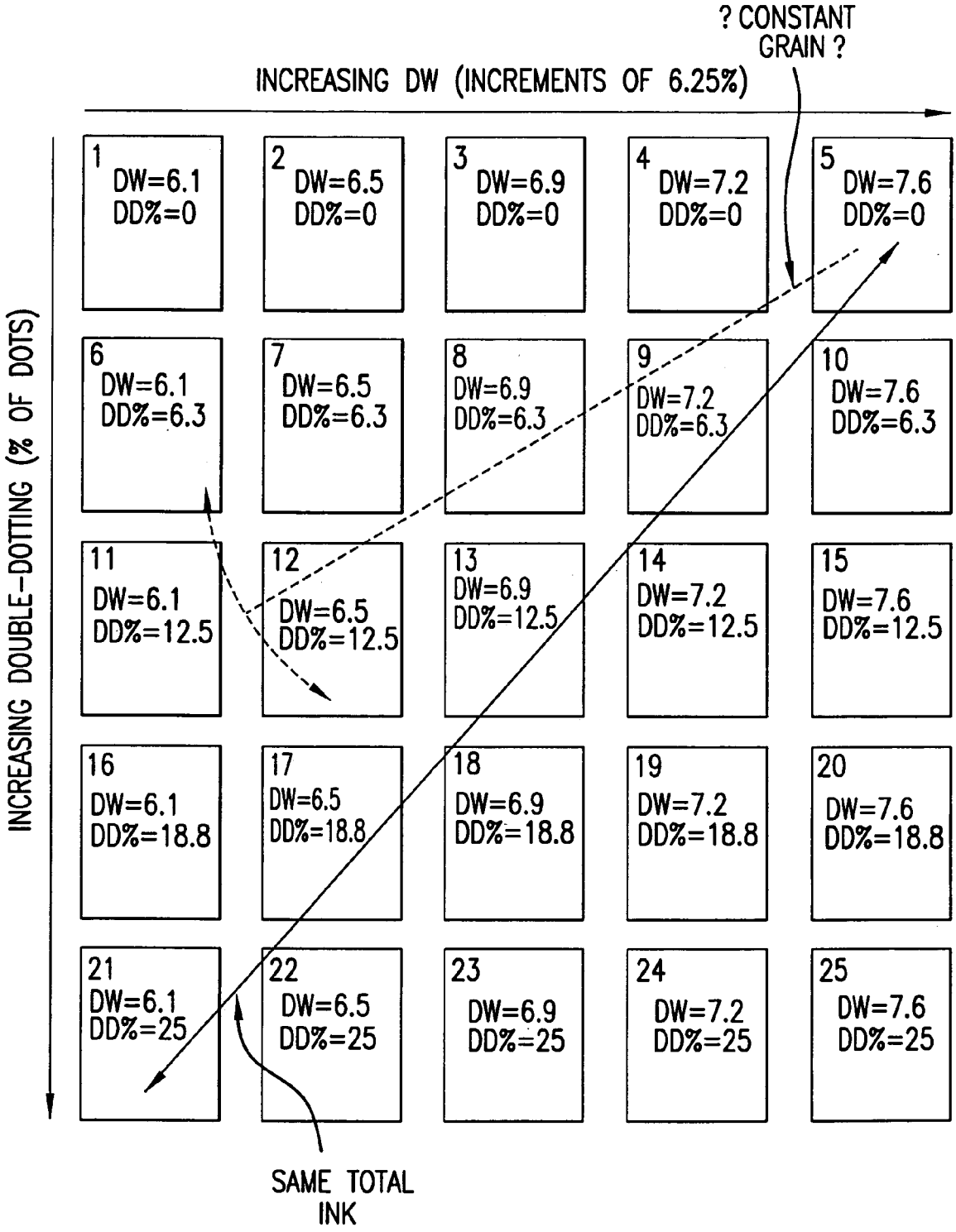
FIG. 5 is a chart that illustrates the effects of double dotting on color and grain, according to another embodiment of the present invention.

After the average drop weight of each die to print a given ink in a multi-die printing system has been measured, an analysis is made to determine the highest drop weight for each color, as shown in step 6. This is accomplished by measuring the actual or relative drop weight, often indirectly such as density measurements, for each die for that particular color. For the die that is utilizing its highest drop weight for that particular ink, double dotting should not have to be performed and the procedure can move to the color compensation algorithm step for that die, as set forth in step 14. However, if the die is not utilizing its highest drop weight for that particular ink, a determination must be made as to what percentage of double dotting is needed to match the grain of the highest drop weight die for that particular ink, as shown in step 8. FIG. 5, which will be discussed later, illustrates the effects of double dotting on grain and color and can be used in order to determine the percentage of double dotting needed to match the grain of the highest drop weight die for that particular ink. It is to be understood that the amount of double dotting can be varied for a given die for different print densities. For example, more double dotting may be utilized for darker area fills and less double dotting could be used for lighter fill areas.

After the double dotting percentage has been determined, a test pattern is printed that includes the calculated amounts of double dotting, as shown in step 10. An example of simple test pattern is a single density of approximately 6 nanograms (ng) ink/600×600 dpi pixels. The color density of the test pattern is then measured for printed densities, among other things, as shown in step 12 and a conventional color compensation algorithm technique is then used to further equalize the color from each die, as shown in step 14.

The color compensation algorithm technique, typically is used to determine the ratio of the dots between the two test patterns in order to match the color between the two test patterns and to compensate for residual die-to-die graininess differences.

It is to be understood that a more general approach to the present invention can be employed. For example, with respect to the drop weight, the present invention works if the absolute drop weight is known. However, the present invention will also work if the relative drop weights between the die are known (i.e., die A has a 20% lower drop weight that die B). Also, with respect to the test pattern, it would be possible to use the present invention without steps 10 and 12 in FIG. 3, if a good understanding of the apparatus were obtained. Finally, with respect to a multi-die system, the present invention works if the multiple die are on a module or if a printer is utilized with multiple pens with one or more die on each pen.

Figure 4:
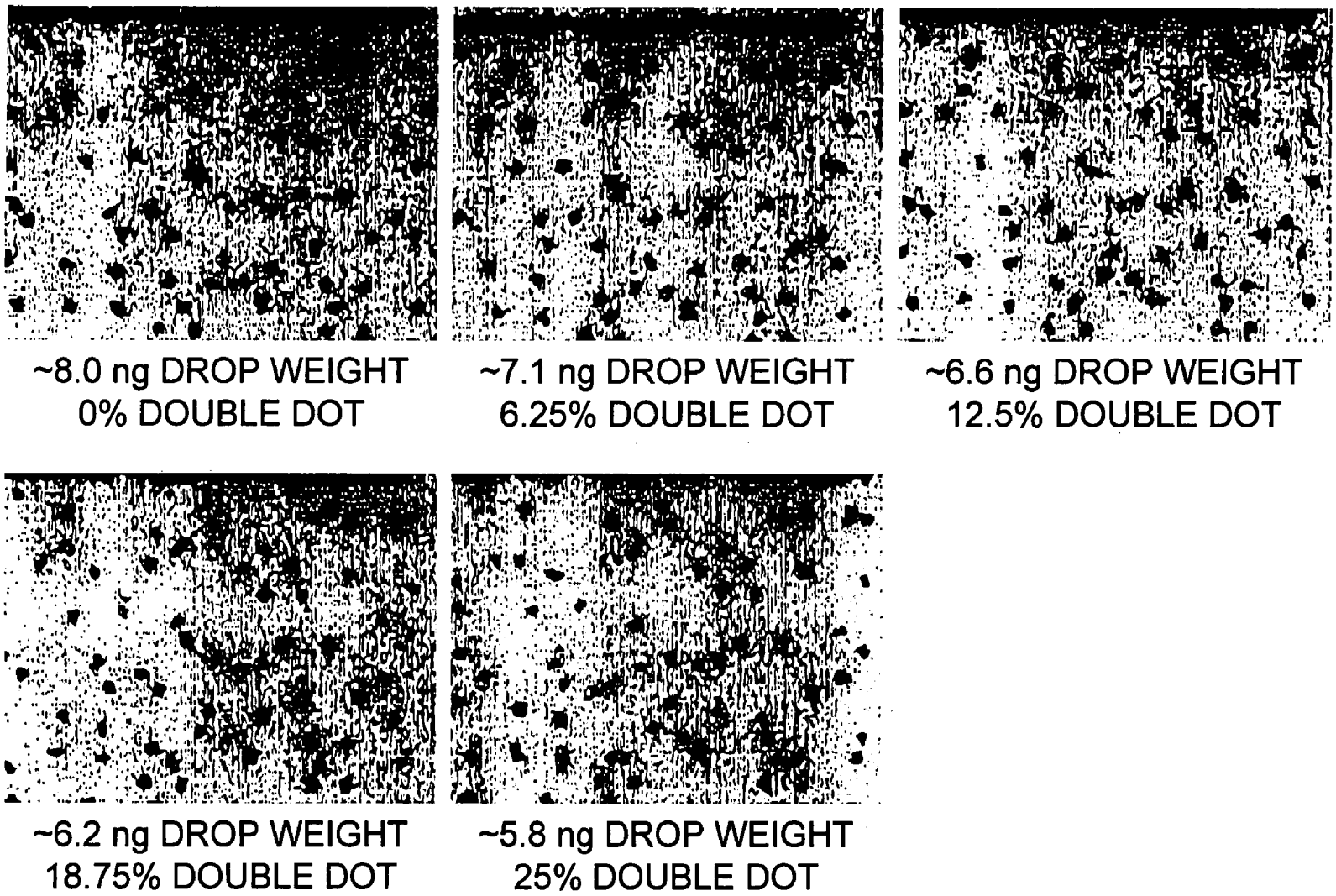
FIG. 4 illustrates a number of photomicrographs of double dotting, according to another embodiment of the present invention.

With respect to FIG. 4, several different photomicrographs of actual double dotting samples are shown. As can be seen in FIG. 4, double dotting 6.25% of the 7.1 ng drops equalizes the grain of 8.0 ng drops with no double dotting. On the other end of the scale, approximately 25% double dotting is required to match the grain of 5.8 ng drops with 8.0 ng drops. Other double dotting percentages can be utilized to match the grain of lower drop weights to the 8.0 ng drop weight.

As discussed above, FIG. 5 illustrates the effects of double dotting on grain and color by comparing the increase in double dotting with an increase in drop weight. As can be seen in the chart in FIG. 5, double dotting increases the grain of a low drop weight die faster than it increases the total amount of ink printed on a sheet of media. If a small drop weight die uses enough double dots to match the colorant level of a high drop weight die, the area fill grain of the small drop weight die will exceed the grain of the large drop weight die.

It is to be understood that the flowchart of FIG. 3 shows the architecture, functionality, and operation of one implementation of the present invention. If embodied in software, each block may represent a module, segment, or portion of code that comprises one or more executable instructions to implement the specified logical function(s). If embodied in hardware, each block may represent a circuit or a number of interconnected circuits to implement the specified logical function(s).

Also, the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Although the flowchart of FIG. 3 shows a specific order of execution, the order of execution may differ from that which is depicted. For example, the order of execution of two or more blocks may be scrambled relative to the order shown. Also, two or more blocks shown in succession in FIG. 3 may be executed concurrently or with partial concurrence. All such variations are within the scope of the present invention.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for grain equalization utilizing double dotting, comprising the steps of:

determining a drop weight of each die in a multi-die printhead to print a given ink;

determining the highest drop weight amongst all of the dies; and determining a percentage of double dotting that is needed to substantially match a grain of the highest drop weight die.

2. The method, as in claim 1, wherein the method is further comprised of the step of:

using a color compensation algorithm to equalize a color from each die.

3. The method, as in claim 1, wherein the method is further comprised of the step of:

printing a test pattern.

4. The method, as in claim 1, wherein the method is further comprised of the step of:

measuring a test pattern.

5. The method, as in claim 1, wherein the method is further comprised of the step of:

determining if a color density of the test pattern is satisfactory.

6. The method, as in claim 1, wherein the highest drop weight determination step is further comprised of the step of:

measuring a relative drop weight between each die for that particular color.

7. The method, as in claim 1, wherein the highest drop weight determination step is further comprised of the step of:

measuring an actual drop weight between each die for that particular color.

8. The method, as in claim 1, wherein the percentage of double dotting determination step is further comprised of the step of:

comparing an increase in double dotting with an increase in drop weight.

9. The method, as in claim 1, wherein the percentage of double dotting determination step is further comprised of the step of:

varying the amount of double dotting employed based upon the content of the printed page.

10. The method, as in claim 1, wherein the test pattern color density determination step is further comprised of the step of:

determining if a color density printed by the adjacent dies is satisfactory.

11. A method for grain equalization in a print job, comprising the steps of:

determining an average drop weight of each die in a multi-die printhead to print a given ink;

determining the highest drop weight amongst all of the dies; determining a percentage of double dotting that is needed to substantially match a grain of the highest drop weight die;

printing a test pattern; and determining if a color density of the test pattern is satisfactory.

12. The method, as in claim 11, wherein the method is further comprised of the step of:

using a color compensation algorithm to compensate for residual die-to-die graininess differences.

13. The method, as in claim 11, wherein the highest drop weight determination step is further comprised of the step of:

measuring an actual drop weight for each die for that particular color.

14. The method, as in claim 11, wherein the highest drop weight determination step is further comprised of the step of:

measuring a relative drop weight for each die for that particular color.

15. The method, as in claim 11, wherein the percentage of double dotting determination step is further comprised of the step of:

comparing an increase in double dotting with an increase in drop weight.

16. The method, as in claim 11, wherein the percentage of double dotting determination step is further comprised of the step of:

varying the amount of double dotting employed based upon printed density levels.

17. The method, as in claim 11, wherein the test pattern printing step is further comprised of the step of:

measuring the test pattern.

18. A program storage medium readable by a computer, tangibly embodying a program of instructions executable by the computer to perform method steps for grain equalization in a print job, comprising the steps of:

determining an average drop weight of each die in a multi-die printhead to print a given ink;

determining the highest drop weight amongst all of the dies; determining a percentage of double dotting that is needed to substantially match a grain of the highest drop weight die; and printing a test pattern.

19. The program storage medium, as in claim 18, wherein the method is further comprised of the step of:

measuring the test pattern.

20. The program storage medium, as in claim 18, wherein the method is further comprised of the step of:

using a color compensation algorithm to compensate for residual die-to-die graininess differences.

21. The program storage medium, as in claim 18, wherein the highest drop weight determination step is further comprised of the step of:

measuring an actual drop weight for each die for that particular color.

22. The program storage medium, as in claim 18, wherein the highest drop weight determination step is further comprised of the step of:

measuring a relative drop weight for each die for that particular color.

23. The program storage medium, as in claim 18, wherein the percentage of double dotting determination step is further comprised of the step of:

comparing an increase in double dotting with an increase in drop weight.

24. The program storage medium, as in claim 18, wherein the percentage of double dotting determination step is further comprised of the step of:

varying the amount of double dotting employed based upon printed densities.

25. The program storage medium, as in claim 18, wherein the test pattern color density determination step is further comprised of the step of:

determining if a color density printed by the adjacent dies is satisfactory.

26. A system for grain equalization in a print job, comprising:

a determining means for determining an average drop weight of each die in a multi-die printhead to print a given ink;

a determining means for determining the highest drop weight amongst all of the dies;

a determining means for determining a percentage of double dotting that is needed to substantially match a grain of the highest drop weight die;

a printing means for printing a test pattern.

27. The system, as in claim 26, wherein the apparatus is further comprised of:

a means for utilizing a color compensation algorithm to equalize a color from each die.

28. The system, as in claim 26, wherein the highest drop weight determination means is further comprised of:

a means for measuring an actual drop weight for each die for that particular color.

29. The system, as in claim 26, wherein the highest drop weight determination means is further comprised of:

a means for measuring a relative drop weight for each die for that particular color.

30. The system, as in claim 26, wherein the percentage of double dotting determination means is further comprised of:

a means for comparing an increase in double dotting with an increase in drop weight.

31. The system, as in claim 26, wherein the percentage of double dotting determination step is further comprised of the step of:

a means for varying the amount of double dotting employed based upon printed densities.

32. The system, as claim 26, wherein the test pattern printing step is further comprised of the step of:

a means for measuring the test pattern.

* * * * *